US007857638B2

(12) United States Patent
Zhu

(10) Patent No.: US 7,857,638 B2
(45) Date of Patent: Dec. 28, 2010

(54) ELECTRICAL CONNECTOR WITH LATCHING MEMBERS

(75) Inventor: Yu Zhu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/506,482

(22) Filed: Jul. 21, 2009

(65) Prior Publication Data

US 2010/0015836 A1 Jan. 21, 2010

(30) Foreign Application Priority Data

Jul. 21, 2008 (CN) ..... 2008 2 0041957

(51) Int. Cl.
*H01R 12/00* (2006.01)

(52) U.S. Cl. ..... 439/78; 439/567

(58) Field of Classification Search ..... 439/78, 439/326, 327, 328, 567, 59
See application file for complete search history.

(56) References Cited

U.S. PATENT DOCUMENTS 4,874,336 A * 10/1989 Marsh ..... 439/607.37
4,943,244 A * 7/1990 Teck et al. ..... 439/567
5,147,220 A * 9/1992 Lybrand ..... 439/567
5,238,413 A * 8/1993 McCaffrey et al. ..... 439/79
5,951,325 A * 9/1999 Tang et al. ..... 439/567
5,961,346 A * 10/1999 Choy ..... 439/567
6,024,602 A * 2/2000 Mchugh et al. ..... 439/567
6,210,218 B1 * 4/2001 Chang ..... 439/567
6,540,553 B1 * 4/2003 Wu ..... 439/567
6,589,077 B1 * 7/2003 Wu ..... 439/567
6,663,406 B1 * 12/2003 Wu ..... 439/326
6,712,632 B2 * 3/2004 Wu ..... 439/328
6,767,235 B2 * 7/2004 Wu ..... 439/328
2008/0176426 A1 * 7/2008 Zhu et al. ..... 439/79
2009/0017677 A1 * 1/2009 Lei ..... 439/567

FOREIGN PATENT DOCUMENTS

CN 2552174 Y 5/2003

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

An electrical connector (100) for mounting onto a printed circuit board (5), includes a longitudinal insulative housing (1), a plurality of contacts (2, 3) received in the housing and a pair of latching members (4) retained to the housing. The housing defines a mating face (104) and a pair of supporting portions (15) disposed at two opposite ends of the housing in an elongated direction, and each supporting portion defines a supporting face (150) and a receiving slot (17) running through the supporting face. Each latching member is retained to a corresponding receiving slot and defines a locking portion (42) extending perpendicularly to the printed circuit board and projecting out of the receiving slot to expose to the supporting face at a free end thereof.

12 Claims, 5 Drawing Sheets

ELECTRICAL CONNECTOR WITH LATCHING MEMBERS

BACKGROUND OF THE INVENTION

1. Field of the Invention

The present invention relates to an electrical connector, and particularly to an electrical connector connecting with a printed circuit board and having a pair of latching members disposed in an insulative housing for latching with the printed circuit board.

2. Description of the Related Art

An electrical connector is widely used in electrical equipments to mate with a complementary connector and electrically connect with a print circuit board to provide an electrical connection between two electrical equipments. Chinese Patent Issued Number 2552174Y discloses a related electrical connector, which connects with a printed circuit board and defines an insulative housing providing a plurality of contacts. The housing defines a pair of opposite sidewalls, and a slot opening outwards and rearwards is disposed in each sidewall. The electrical connector is assembled into a cutout edge portion of the printed circuit board, and printed circuit board disposed around the cutout edge portion enters into the slot and is clipped by opposite clipping walls of the slot, which can provide a strong connection between the connector and the printed circuit board. But, the height of the sidewalls of the housing will be reduced to suit for miniaturization, and the clipping walls of the slot will become too thin to provide a retaining force to retain the electrical connector to the printed circuit board steadily, which may cause the electrical connector break off from the printed circuit board easily.

Hence, a new design which can provide a strong connection between the electrical connector and the printed circuit board is provided.

SUMMARY OF THE INVENTION

Accordingly, an object of the present invention is to provide an electrical connector having a pair of latching members for latching with a printed circuit board.

In order to achieve the object set forth, an electrical connector for mounting onto a printed circuit board, includes a longitudinal insulative housing, a plurality of contacts received in the housing and a pair of latching members retained to the housing. The housing defines a mating face and a pair of supporting portions disposed at two opposite ends of the housing in an elongated direction, and each supporting portion defines a supporting face and a receiving slot running through the supporting face. Each latching member is retained to a corresponding receiving slot and defines a locking portion extending perpendicularly to the printed circuit board and projecting out of the receiving slot to expose to the supporting face at a free end thereof.

Other objects, advantages and novel features of the invention will become more apparent from the following detailed description of the present embodiment when taken in conjunction with the accompanying drawings.

DETAILED DESCRIPTION OF THE INVENTION

Figure 1:
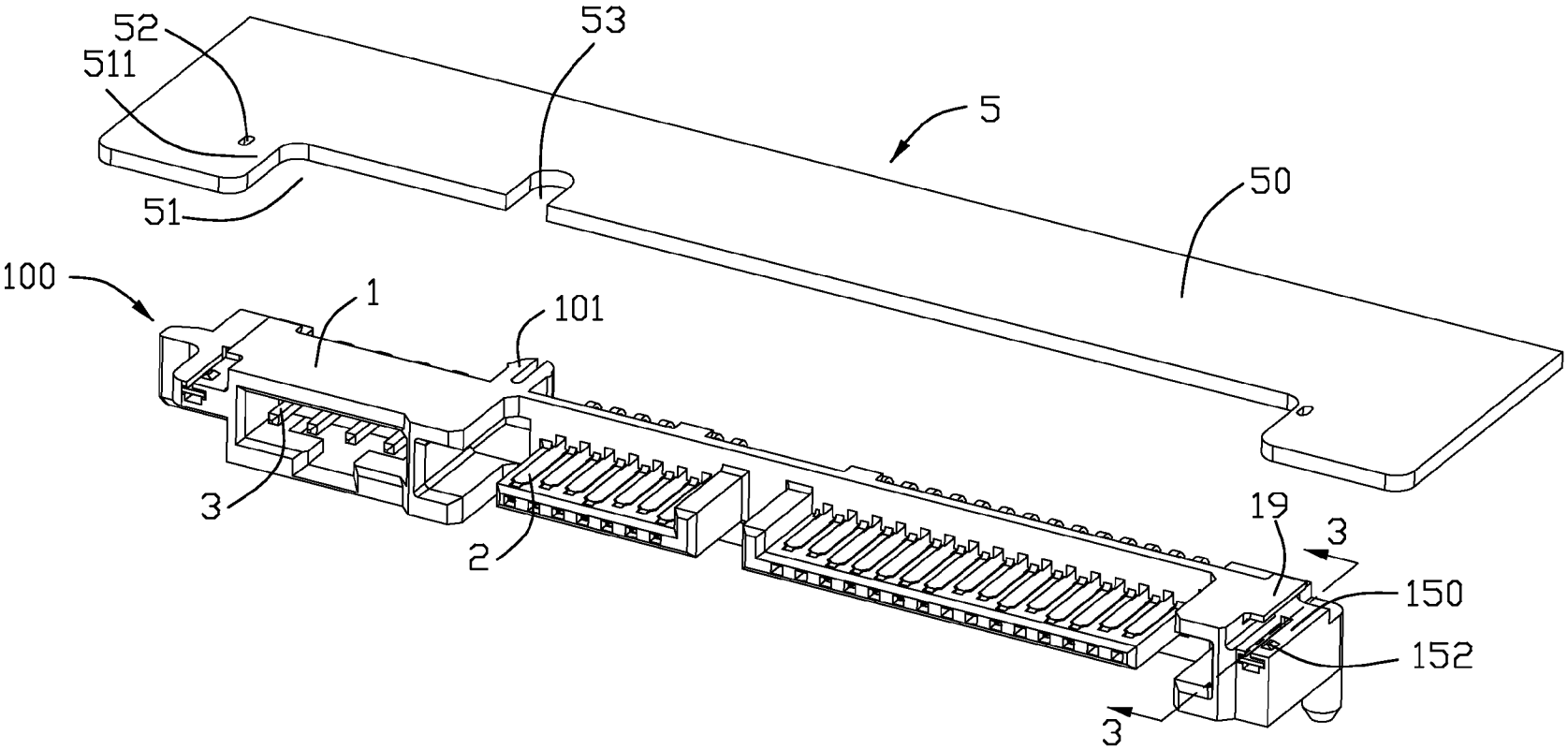
FIG. 1 is a perspective view of an electrical connector in accordance with a preferred embodiment of the present invention separating from a printed circuit board.

Reference will now be made to the drawing figures to describe a preferred embodiment of the present invention in detail.

Figure 2:
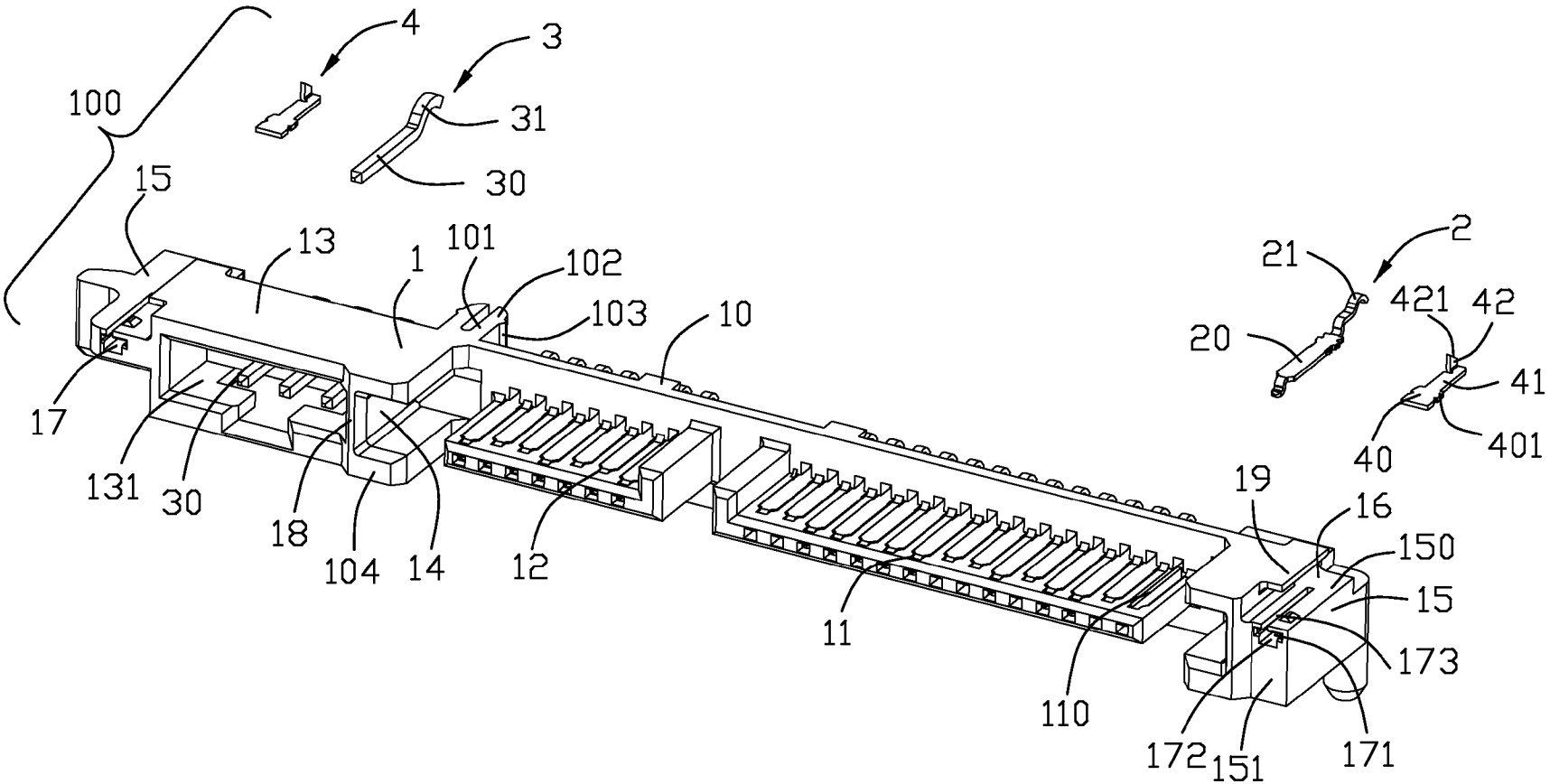
FIG. 2 is a partly exploded view of the electrical connector shown in FIG. 1.

Referring to FIG. 1 and FIG. 2, an electrical connector 100 for mounting onto a printed circuit board 5 is used to provide an electrical connection between two electrical equipments. The electrical connector defines an insulative housing 1, a plurality of first and second contacts 2, 3 received in the housing, and a pair of latching members 4 separately disposed in two ends of the housing.

Referring to FIG. 2, the housing defines a longitudinal base portion 10 and three mating portions 11, 12, 13 separately extending forward from the base portion 10. The three mating portions 11, 12, 13 arrange in a longitudinal direction, and the mating portions are used to mate with electronic components, such as a mating connector. The first and second mating portions 11, 12 are both L-shaped mating tongues adjacent to each other, and the third mating portion 13 defines a mating cavity 131 running through a mating face 104 of the electrical connector. The vertical sides of the first and second mating portions 11, 12 are disposed adjacent and face to each other. The housing further defines a pair of guiding portions 14 space from each other in the longitudinal direction, and the adjacent first and second mating tongues 11, 12 are disposed between the two guiding portions 14. In this embodiment, the guiding portion 14 is defined as a guiding slot running through the mating face 104 and opening towards the adjacent mating portion, and the third mating portion 13 and the adjacent second mating portion 12 are disposed at two sides of a guiding slot. The third mating portion 13 and the guiding slot 14 have a same sidewall 18. The first contacts 2 are disposed on the first and second mating tongues 11, 12, and the contacting portions 20 are received in the corresponding receiving grooves 110 defined on a top face of the first and second mating tongues 11, 12 thereof and the soldering portions 21 extend out of the housing for connecting with the printed circuit board 5. The second contacts 3 are assembled to the third mating portion 13, and the contacting portions 30 project into the mating cavity 131 and the soldering portions 31 extend out of the housing for connecting with the printed circuit board 5.

Referring to FIG. 2, the housing further defines a pair of supporting portions 15 integrally extending outwards from two outmost ends in the longitudinal direction. A pair of clipping portions 19 each integrally extends outwards from a top face of the housing and locates above a corresponding supporting portion 15, and a clipping slot 16 running through the front face 104 and the opposite rear face of the housing and opening outwards is provided between the supporting portion 15 and the clipping portion 19. The clipping slot 16 is used to receive the printed circuit board 5, and a top face 150 exposed to the clipping slot 16 is defined as a supporting face for supporting the printed circuit board 5, and the supporting face 150 is defined as a bottom face of the clipping slot 16. Each supporting portion 15 defines a receiving slot 17 opening forwards and upwards, and each receiving slot 17 defines a retaining slot 171 and a receiving portion 172 disposed under the retaining slot 171 and communicating with the retaining slot 171. The retaining slot 171 runs through the supporting face 150 and a slot 173 is formed at the supporting face 150 thereof. The retaining slot 171 communicates with the clipping slot 16. The base portion 10 defines a latching portion 101 extending rearwards from a rear wall opposite to the front face 104 at a joint of the second mating portion 12 and the third mating portion 13, and the latching portion 101 defines a pair of locking legs 102 space from each other and each defines a rib portion 103 at an outer face thereof.

Figure 3:
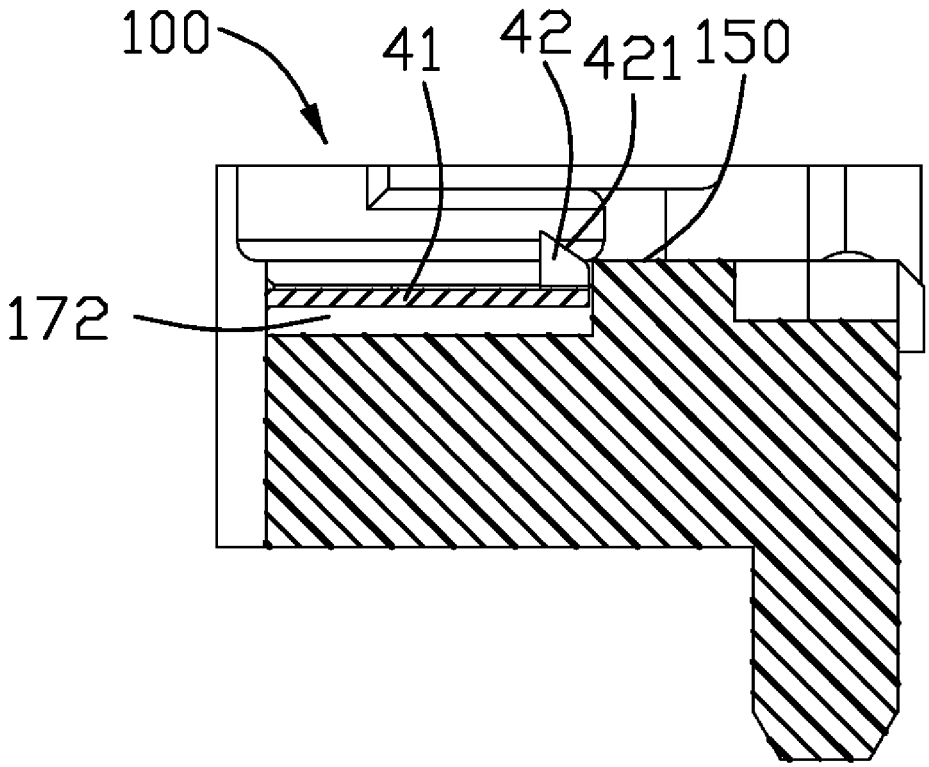
FIG. 3 is a cross-sectional view of the electrical connector taken along line 3-3 of FIG. 1.

Referring to FIG. 2 and FIG. 3, each latching member 4 defines a board-shaped retaining portion 40, an elastic arm 41 extending flatly from the retaining portion 40 and a locking portion 42 extending upwards and perpendicularly to the printed circuit board 5 from a side edge of a free end of the elastic arm 41. The retaining portion 40 and the elastic arm 41 are disposed in a same plane parallel to the printed circuit board 5, and the locking portion 42 is perpendicular to the retaining portion 40 and the elastic arm 41. A side edge 421 of the locking portion 42 is slantwise and is defined as a guiding portion. In this embodiment, the locking portion 42 is defined as a hook portion, and the elastic arm 41 has a smaller width than that of the retaining portion 40 in the longitudinal direction to improve the flexibility of the elastic arm 41. Each latching member 4 is assembled to the corresponding receiving slot 17 from the front face 151 of the supporting portion 15, and the retaining portion 40 is received in the retaining slot 171 and retained thereto by the engaging portions 401 which are disposed at two opposite side edges of the base portion 40 engaging with the retaining slot 171. The elastic arm 41 locates above the receiving portion 172, and the hook portion 42 runs through the slot 173 and exposed to the supporting face 150.

Figure 4:
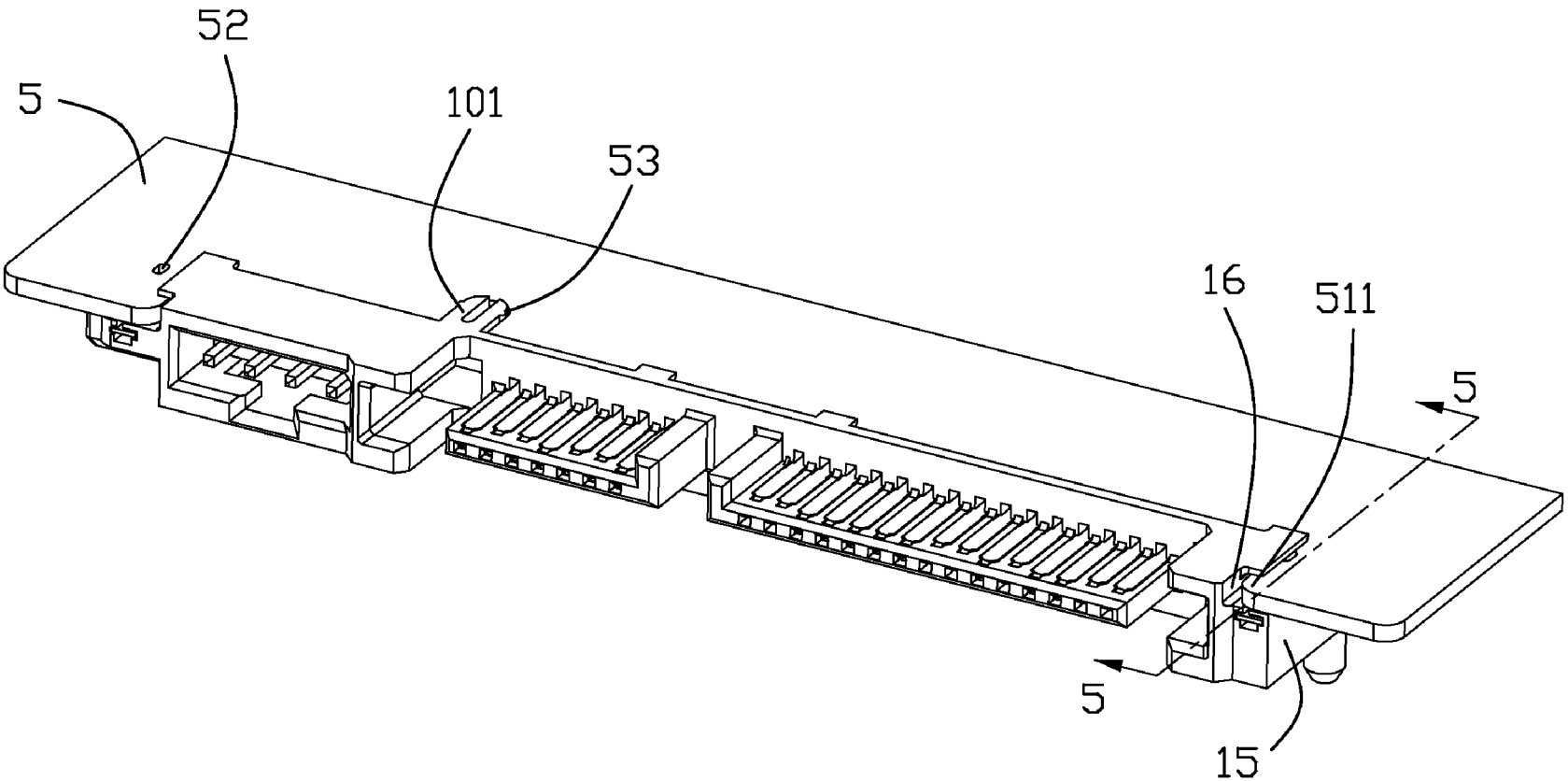
FIG. 4 is a perspective view of an electrical connector assembly showing the electrical connector assembled to the printed circuit board.
Figure 5:
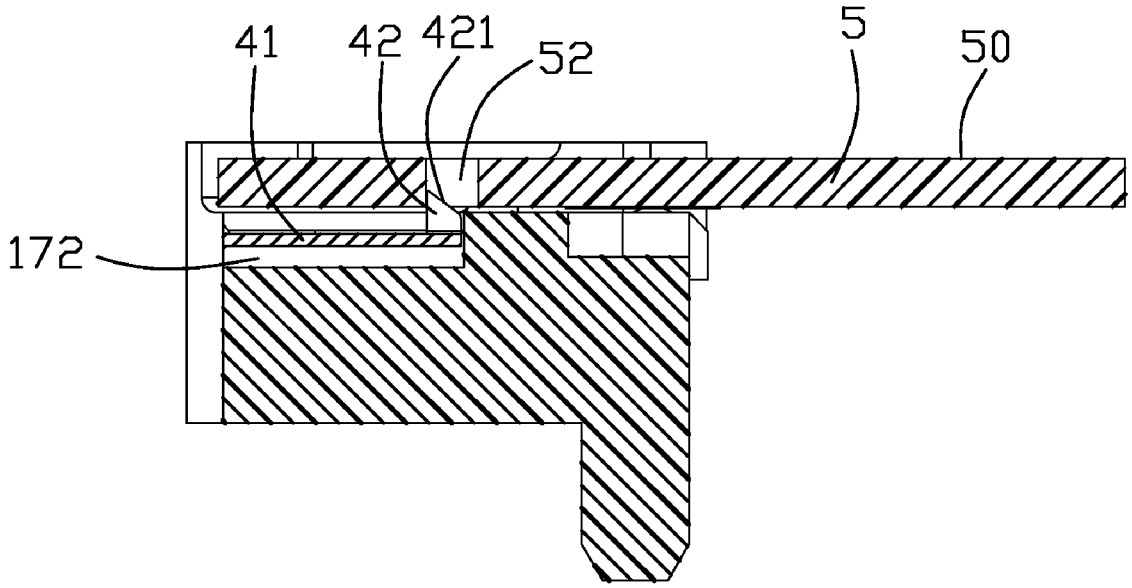
FIG. 5 is a cross-sectional view of the electrical connector assembly taken along line 5-5 of FIG. 4.

Referring to FIG. 1, FIG. 4 and FIG. 5, the printed circuit board 5 defining a cutout edge section 51 has an upper surface 50 and a bottom surface opposite to the upper surface 50, a pair of through holes 52 running through the upper and bottom surfaces are disposed beside the cutout edge section 51. The electrical connector 100 moves to the cutout edge section 51 in a front-to-rear direction, and two opposite side edge portions 511 of the cutout edge section 51 enter into the clipping slots 16, synchronously, the guiding portions 421 guide the connector moving towards the printed circuit board 5 in a mating direction, and the locking portions 42 are pressed to enter into the receiving portion 172 by the elastic arm 41 moving downwards in an elastic deformation manner. When the locking portion 42 aligns with the through hole 52 during the movement of the electrical connector 100, the elastic arm 41 relaxes to be a normal state and the locking portion 42 enters into the through hole 52 to locks with the through hole 52, and each side edge portion 511 is clipped between the clipping portion 19 and the supporting face 15, and a strong connection between the electrical connector 100 and the printed circuit board 5 is provided. The locking portion 42 locks with the through hole 52 and does not extend out of the through hole. A rib portion 152 disposed on each supporting face 150 may engage with the bottom surface of the printed circuit board 5, and the latching portion 101 may lock with a locking hole 53 disposed in the cutout edge section 51, and the rib portions 152 and the latching portion 101 are disposed to retain the connector to the printed circuit board 5 steadily. Moreover, the locking portion 42 is received in the through hole 52 without any portion extending beyond the upper surface 50 of the printed circuit board 5, which may reduce the height of the electrical connector to suit for miniaturization.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a printed circuit board defining opposed upper and bottom surfaces and a pair of retaining holes; and an electrical connector for mounting onto the printed circuit board, including an insulative housing having a longitudinal base portion, at least one mating portion extending forwards from the base portion and a pair of supporting portions disposed at two opposite ends of the base portion in an elongated direction, each supporting portion defining a supporting face for supporting the printed circuit board thereon and a receiving slot running through the supporting face;

a plurality of contacts received in the mating portions; and a pair of latching members retained to respective receiving slots and each defining a locking portion exposed to the supporting face, and each locking portion extending into a corresponding retaining hole upwards without any portion disposed beyond the upper surface of the printed circuit board when the locking portion is aligned with the retaining hole during the movement of the electrical connector.

2. The electrical connector assembly as described in claim 1, wherein the locking portions guide the electrical connector moving towards the printed circuit board.

3. The electrical connector assembly as described in claim 1, wherein each supporting portion integrally extends outwards from the base portion.

4. The electrical connector assembly as described in claim 1, wherein each latching member defines a board-shaped retaining portion and an elastic arm extending from the retaining portion, and the locking portion bends from a side edge of a free end of the elastic arm.

5. The electrical connector assembly as described in claim 4, wherein the retaining portion and the elastic arm are disposed in a same plane parallel to the printed circuit board, and the locking portion is perpendicular to the plane.

6. The electrical connector assembly as described in claim 5, wherein each receiving slot defines a retaining slot and a receiving portion located under the retaining slot, the retaining slot runs through the supporting face and communicates with the retaining slot, and the locking portion runs through the retaining slot to expose to the supporting face.

7. An electrical connector assembly comprising:

an insulative housing defining a mating port in a front portion for horizontally mating with a complementary connector and a mounting port in a rear portion;

a plurality of contacts disposed in the housing, each of said contacts including a contacting section located in the mating port and a tail section located in the mounting port for mounting to a printed circuit board;

a pair of horizontal clipping slots formed around two opposite ends of the housing; and a deflectable latching member located around the corresponding end of the housing and including a hook portion extending into the clipping slot; wherein the tail sections of the contacts are configured with a surface mounting type for surface engagement with said printed circuit board, and the clipping slot is configured to comply with a thickness of said printed circuit board so as to receive said printed circuit board therein.

8. The electrical connector assembly as claimed in claim 7, wherein the clipping slot is open to an exterior for allowing the printed circuit board to be forwardly assembled to the housing from the rear portion.

9. The electrical connector assembly as claimed in claim 7, wherein when the printed circuit board is received in the clipping slot, the hook portion locks the printed circuit board for preventing withdrawal of the connector from the printed circuit board.

10. The electrical connector assembly as claimed in claim 9, wherein said printed circuit board defines a locking hole into which said hook portion extends.

11. The electrical connector assembly as claimed in claim 7, wherein said clipping slot is formed by the housing.

12. The electrical connector assembly as claimed in claim 7, wherein the housing further includes a post extending downwardly away from the printed circuit board.

* * * * *